US008561712B2

(12) United States Patent
McKim et al.

(10) Patent No.: US 8,561,712 B2
(45) Date of Patent: Oct. 22, 2013

(54) AUTOMATIC STOVE TOP FIRE SUPPRESSION MODULE

(76) Inventors: Royce McKim, Austin, TX (US); James Pate, Waxahachie, TX (US)

( * ) Notice: Subject to any disclaimer, the term of this patent is extended or adjusted under 35 U.S.C. 154(b) by 1403 days.

(21) Appl. No.: 10/585,904

(22) PCT Filed: Jan. 14, 2004

(86) PCT No.: PCT/US2004/000995

§ 371 (c)(1),
(2), (4) Date: May 7, 2007

(87) PCT Pub. No.: WO2005/077465

PCT Pub. Date: Aug. 25, 2005

(65) Prior Publication Data

US 2007/0215363 A1 Sep. 20, 2007

(51) Int. Cl.
*A62C 8/00* (2006.01)

(52) U.S. Cl.
USPC ..... 169/49; 169/65

(58) Field of Classification Search
USPC ..... 169/48, 49, 65
See application file for complete search history.

(56) References Cited

U.S. PATENT DOCUMENTS

| | | | | |
|---|---|---|---|---|
| 2,030,468 | A | 2/1936 | Rahlmann | |
| 3,209,837 | A * | 10/1965 | Freedman | 169/42 |
| 3,653,443 | A | 4/1972 | Dockery | |
| 3,773,111 | A | 11/1973 | Dunn | |
| 3,824,374 | A | 7/1974 | Mayher | |
| 4,157,526 | A | 6/1979 | Davies | |
| 4,256,181 | A | 3/1981 | Searcy | |
| 4,580,638 | A * | 4/1986 | Jones et al. | 169/49 |
| 4,813,487 | A | 3/1989 | Mikulec et al. | |
| 4,830,116 | A | 5/1989 | Walden et al. | |
| 4,834,188 | A | 5/1989 | Silverman | |
| 5,186,260 | A | 2/1993 | Scofield | |
| 5,207,276 | A | 5/1993 | Scofield | |
| 5,297,636 | A | 3/1994 | North | |
| 5,518,075 | A | 5/1996 | Williams | |
| 6,029,751 | A | 2/2000 | Ford et al. | |
| 6,276,461 | B1 | 8/2001 | Stager | |
| 6,360,825 | B1 | 3/2002 | Padgett et al. | |

FOREIGN PATENT DOCUMENTS

| | | |
|---|---|---|
| JP | 57-45955 | 8/1955 |
| JP | 05-200127 | 8/1993 |
| JP | 3041706 | 7/1997 |
| JP | 10-201871 | 8/1998 |
| WO | WO2005/077465 A1 | 8/2005 |

* cited by examiner

*Primary Examiner* — Davis Hwu
(74) *Attorney, Agent, or Firm* — Scheinberg & Associates, PC; Michael O. Scheinberg

(57) ABSTRACT

An apparatus for extinguishing fires in stoves used in food preparation. This invention detects a grease fire on the stovetop by detecting an elevated temperature associated with a grease fire and releases a fire suppression agent into the burning pan. A trigger mechanism retracts a restraining pin releasing the lever and cover. A packet of dry fire suppression agent with a foil separator falls using gravity. The foil separator is folded in a manner that divides the fire suppression agent into smaller portions.

20 Claims, 12 Drawing Sheets

AUTOMATIC STOVE TOP FIRE SUPPRESSION MODULE

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF INVENTION

1. Field of the Invention

Apparatus for extinguishing fires in stoves used in food preparation. Grease fire is one of the main causes of serious structure fires. The purpose of this invention provides an inexpensive means of protection against grease fires on stovetop and ranges. Existing methods for controlling grease fires are either costly or with little control of the velocity at which the suppression agent contacts the burning grease, causing splashing of the burning media. The "Automatic Stove Top Fire Suppression Module" releases the fire suppression agent in several brief rapid layers resulting in a rapid extinguishing of fire and with sufficient quantity to prevent reignition. This unique delivery system is believed to be the only system that divides the dry fire suppression agent in small portions with multiple pulses controlling the decent and direction of fire suppression agent as the agent is deployed.

2. Description of Prior Art

Prior art for controlling grease fires on stoves is will noted. Prior arts for controlling grease fires are either expensive, difficult to install, unreliable, unsightly, requires additional storage or causes splashing of the burning grease. Some examples of prior art and the problems that are solved this unique invention is briefly described below.

An example of prior art is disclosed in U.S. Pat. No. 2,030,468 issued to Rahlmann. A cable system requiring attachments of pulleys and weights. Requiring extensive modifications for installation and not practical with today kitchens.

Another example of prior art is disclosed in U.S. Pat. No. 3,653,443 issued to Dockery. A system requiring experienced electrician for installation with several unsightly switches and controls.

Another example of prior art is disclosed in U.S. Pat. No. 3,824,374 issued to Mayher. A system requiring additional storage and modifications of surrounding structure for installation.

Another example of prior art is disclosed in U.S. Pat. No. 4,157,526 issued to Davies. A system of unsightly cables and pulley that is not practical for controlling stove fires and requiring extensive installation cost.

Another example of prior art is disclosed in U.S. Pat. No. 4,256,181 issued to Searcy. This system requires a modification of surrounding cabinets by drilling access holes for hoses and pipes in addition to additions storage requirements for pressure vessel.

Another example of prior art is disclosed in U.S. Pat. No. 4,813,487 issued to Mikulec. This system, although contained under the venting hood, requires several mounting points where attachments must be made. The system also requires custom configurations for different configurations of venting hoods.

Another example of prior art is disclosed in U.S. Pat. No. 4,830,116 issued to Walden. This system requires remote storage of pressure vessel and custom installation of nozzles.

Another example of prior art is disclosed in U.S. Pat. No. 4,834,188 issued to Silverman. This system requires mounting of cables and pulleys, modification of surrounding structure with access hole for piping, and additional storage for pressure vessel.

Another example of prior art is disclosed in U.S. Pat. No. 5,186,260 issued to Scofield. This system requires remote storage of pressure vessel and custom installation wiring and fuse link.

Another example of prior art is disclosed in U.S. Pat. No. 5,207,276 issued to Scofield. This system requires remote storage of pressure vessel and custom installation wiring and fuse link.

Another example of prior art is disclosed in U.S. Pat. No. 5,518,075 issued to Padgett. This is a self-contained system using and explosive device to propel a fire extinguishing powder into the burning pan. The acceleration of the fire extinguishing powder created by the explosive device increases the chances of splashing burning grease onto the surrounding stove area. Control of the direction that the powder is deployed is dependent on the rupture configuration caused by the explosive charge and not consistent.

Another example of prior art is disclosed in U.S. Pat. No. 6,276,461 issued to Stager. This is a self-contained system that is mounted to the venting hood and when a fire is detected the unit swings down and the fire suppression material is force out of an opening by a spring. The spring accelerating the fire suppression material and the possibility of large clusters of fire suppressing material striking the burning grease increases the chances for splashing burning grease onto the stovetop or surrounding area.

Another example of prior art is disclosed in U.S. Pat. No. 6,360,825 issued to Williams. This is a self-contained system that is mounted to the venting hood and when a fire is detected the unit forces a fire suppression media through an opening onto the burning fire. The forcing of a dry media through a reduce opening is unreliable due to the compaction of the dry material. Some compaction always occurs and full deployment of the dry fire suppression media is not achieved.

BRIEF SUMMARY OF THE INVENTION

This invention is designed to be use on a stove or range with burner in line front and rear with a venting hood mounted above the burners. This invention uses magnets for installation and requires no special skill or tools for installation.

This invention stores a dry fire suppression agent above the burner in a sealed enclosure and is automatically dispensed when a fire is detected. This invention detects a grease fire on the stovetop by detecting an elevated temperature associated with a grease fire and releases a fire suppression agent into the burning pan, extinguishing the flames. Three embodiments of a trigger mechanism are disclosed and two embodiments of a foil separator are disclosed. A trigger mechanism retracts a restraining pin releasing the lever and cover. A packet of dry fire suppression agent with a foil separator falls using gravity. The foil separator is folded in a manner that divides the fire suppression agent into smaller portions. As the falling packet descends toward the burner, the foil separator distributes pulses of the dry agent alternately toward the front and rear burner. The action of unfolding the foil slows the decent rate of the dry agent and directs the dry agent in controlled manner covering both the front and rear burners with the dry agent.

The dry agent has sufficient quantity causing the grease to cake or solidify preventing reignition.

BRIEF DESCRIPTION OF THE SEVERAL VIEWS OF THE DRAWING

This document contains 14 Figures to illustrate the instillation and method of storing and deploying the fire-extinguishing agent.

DETAILED DESCRIPTION OF THE INVENTION

Figure 1:
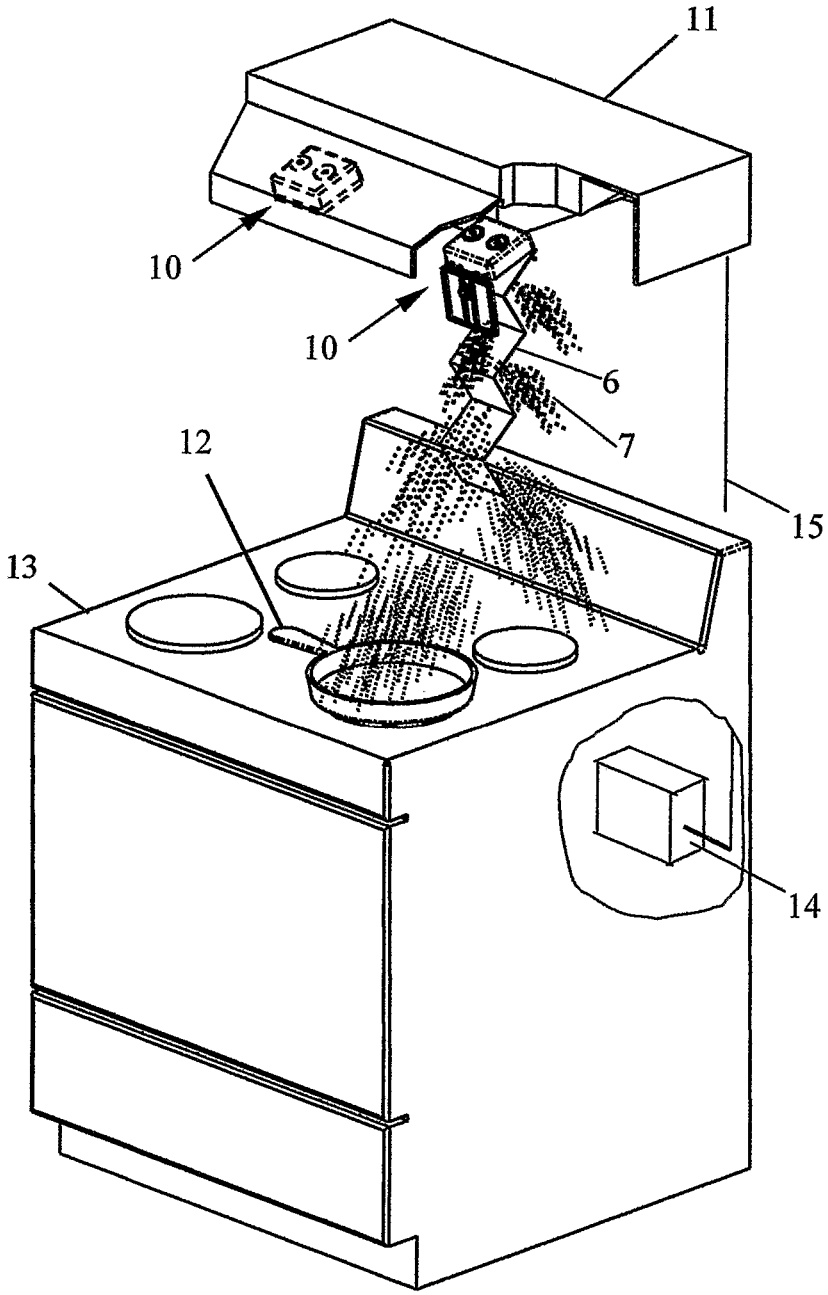
FIG. 1 perspective a typical stove arrangement with two present inventions installed.

As illustrated in FIG. 1 this invention 10 mounts to the underside of 11, a venting hood, above and between the front and rear burners. When a grease fire is detected in pan 12 a dry fire suppression agent is release into to burning pan extinguishing the flames and with sufficient quantity to prevent any reignition. A novel means of releasing a dry fire suppression agent is disclosed in this invention. The dry fire suppression agent is wrapped in alternating folds of foil. When released, gravity pulls the foil and dry fire suppression agent toward the stove and as this combination of materials falls, the unfolding action of the foil divides the total of dry fire suppression agent into several smaller units. As the foil and dry fire suppression agent descends, the energy of this falling mass unfolds the foil guiding and dividing the fire suppression materials in opposite directions, and into smaller units. Short spaces are created between these units traveling toward the front burner and the unit traveling toward the rear burners. As the fire suppression agent continues toward the fire resistance of the air, combined with the updraft created by the fire, breaks up these smaller units of fire suppression agents into a cloud of fire suppression agents. This cloud settles in the areas of the front and rear burners blanketing the fire with this cloud of fire suppression agent. The fire is quickly extinguished and a sufficient quantity of fire suppression agent is deposited into the burning pan to prevent reignition.

Figure 2:
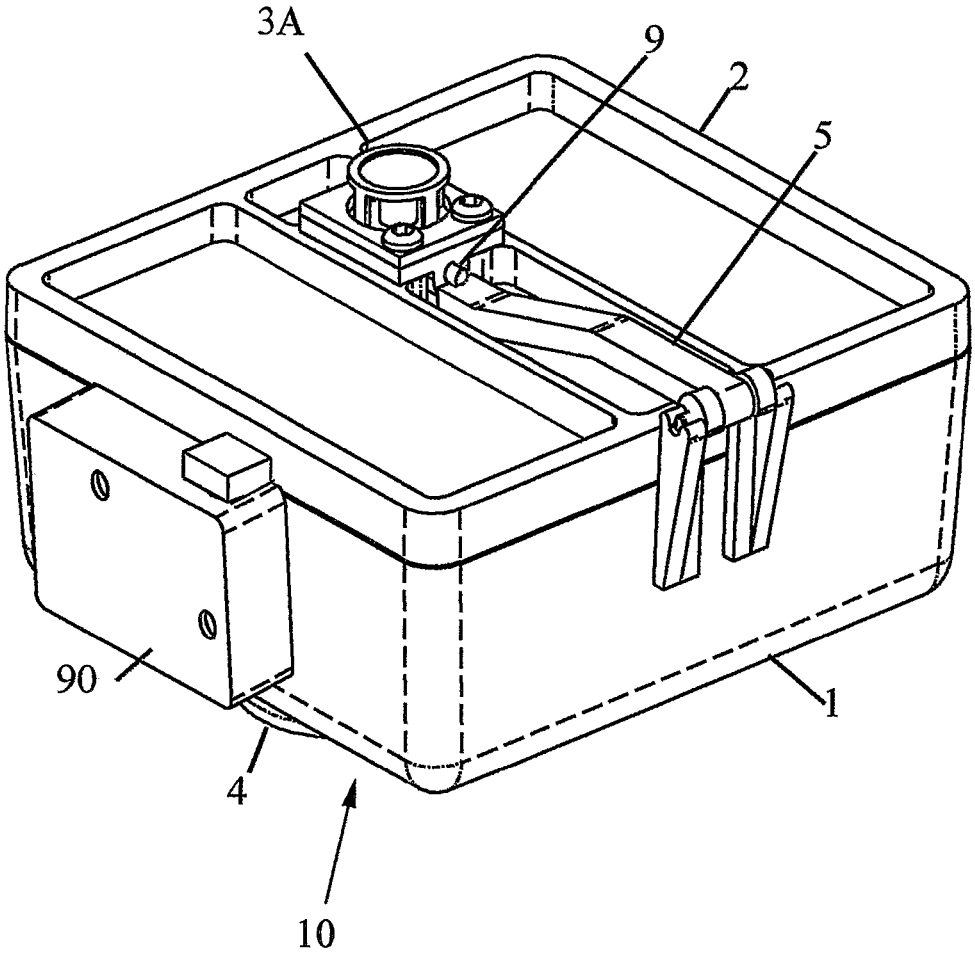
FIG. 2 is a perspective view of present invention and illustrates the first embodiment of the trigger mechanism

This unique method of deploying the fire suppression agent is achieved by configuring the fire suppression agent and foil in the following manner. The beginning of the foil 6 is attached the bottom of enclosure 1 by pressing the foil over the bosses 31 and secured. The fire suppression agent fills the void created by folds in the foil 6 and is illustrated as the location of fire suppression agent. A graphic representation of 7 is illustrated in FIG. 1 being deployed. A thin layer of fire suppression agent 7 is evenly distributed over the bottom surface of enclosure 1. The loose end of 6 is then folded over the first layer of 7. This front to back layering of 6 and 7 is continued until the total enclosure is filled with the fire suppression agent 7 and foil 6, as illustrated by the folded configuration of foil 6 in FIGS. 3, 4, 5, 6, 7 and 11. A seal 8 is placed between enclosure 1 and hinged cover 2. The hinged lever 5 is pressed into its stored position as illustrated in FIG. 2 and the trigger mechanism 3A is secured to cover 2 in turn securing lever. The lever applies pressure on cover to maintain sealing forces between 1, 2 and 8. The fire suppression material is now sealed from contaminants associated with the cooking and venting hood area of the kitchen.

Figure 3:
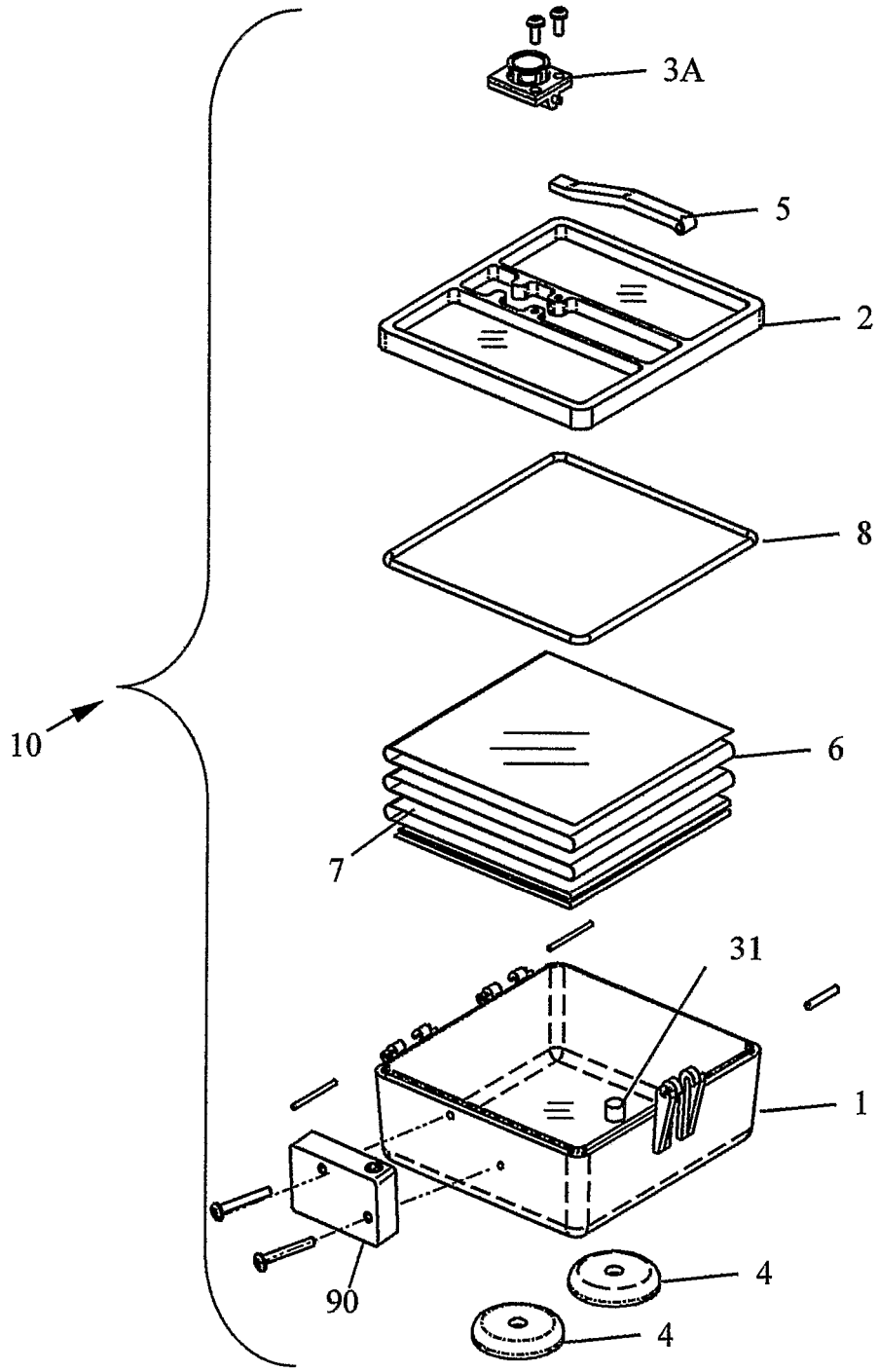
FIG. 3 is an exploded view of the components used in the fire extinguisher present invention first embodiment illustrating the first trigger mechanism.
Figure 8:
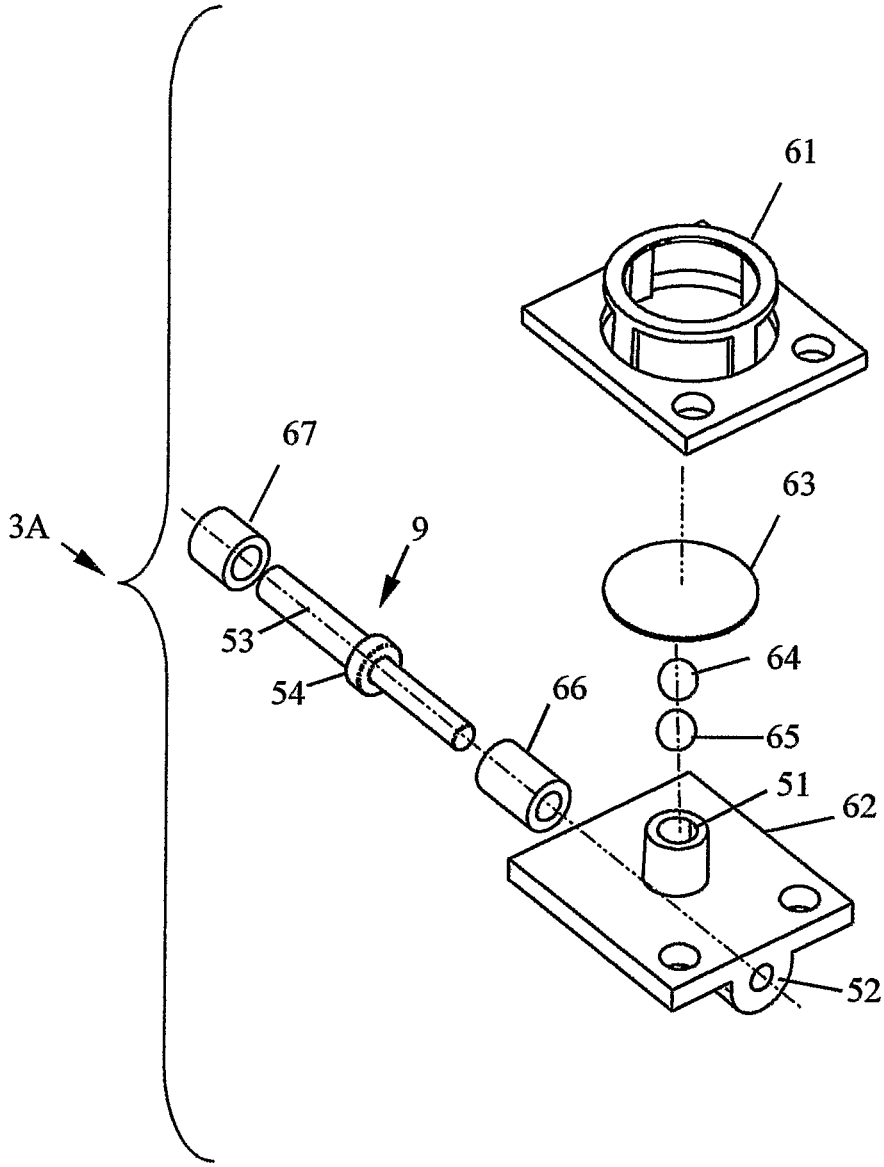
FIG. 8 is an exploded view of the components of the first trigger mechanism.

Four configurations of the trigger mechanism is will be disclosed. The first trigger mechanism 3A is illustrated in FIGS. 2, 3, and 8. FIG. 8 is an exploded view of components that make up the trigger mechanism 3A. Housing 62 FIG. 8 contains two intersecting guide holes 51 and 52. The retracting pin 9 and compression spring 66 are placed in hole 52 and retainer 67 is secured in the back of guide hole 52 as illustrated in FIG. 8. Balls 64 and 65 are placed in hole 51. Bi-metal disk 63 is placed in the cavity of cap 61. Retracting pin 9 is pushed forward to allow ball 65 to rest against shoulder 54 and surface 53 of 9. This will allow top housing 61 to rest fully against lower housing 62. This trigger mechanism can now be attached to cover 2 as illustrated in FIG. 2 with lever 5 between retracting pin 9 and cover 2. The bi-metal disk 63 is a convex disk that snaps to a concave condition when temperature rises above its designed set point. Bi-metal disk are commonly used for thermal protecting in electrical devices. A fire in the pan 12 will rapidly cause the disk 63 to rise above this set point. With the disk in the concave condition the balls 64 and 65 is forced into this space and the retracting pin is allowed to pass under ball 65 and move to its fully retracted position. The forces require to restrain the retracting pin 9 could not be achieved by the bi-metal disk directly. A mechanical advantage is cleverly achieved by placing the contact points of the ball 65 at an angle that reduces the forces on the bi-metal disk 63 while retaining sufficient force to displace the balls 64 and 65 when no longer secured by bi-metal disk 63. To reduce the time require to heat bi-metal disk 63 past its set-point, the disk 63 has been placed facing the heat source, fire in pan 12. Additionally venting to the backside of the disk has been allowed for by openings cap 61 and the thermal path to the mass of the other components of the system has been reduced. The combination of features disclosed in this paragraph yields a sensor that is activated only when the extreme temperatures of a grease fire is detected and greatly reduces the chances of false activation.

Figure 4:
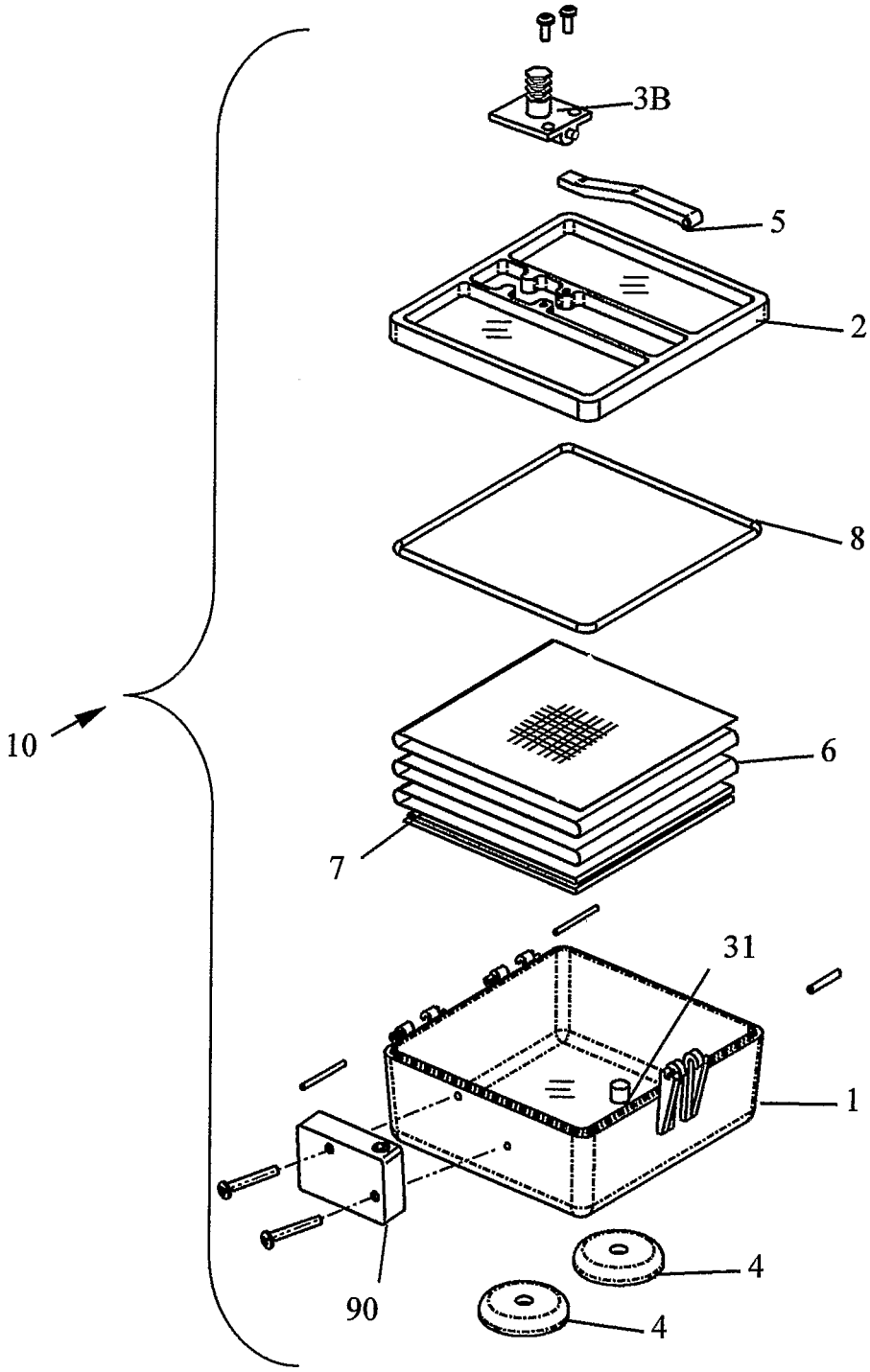
FIG. 4 is an exploded view of the components used in the fire extinguisher present invention second embodiment illustrating the second trigger mechanism.
Figure 9:
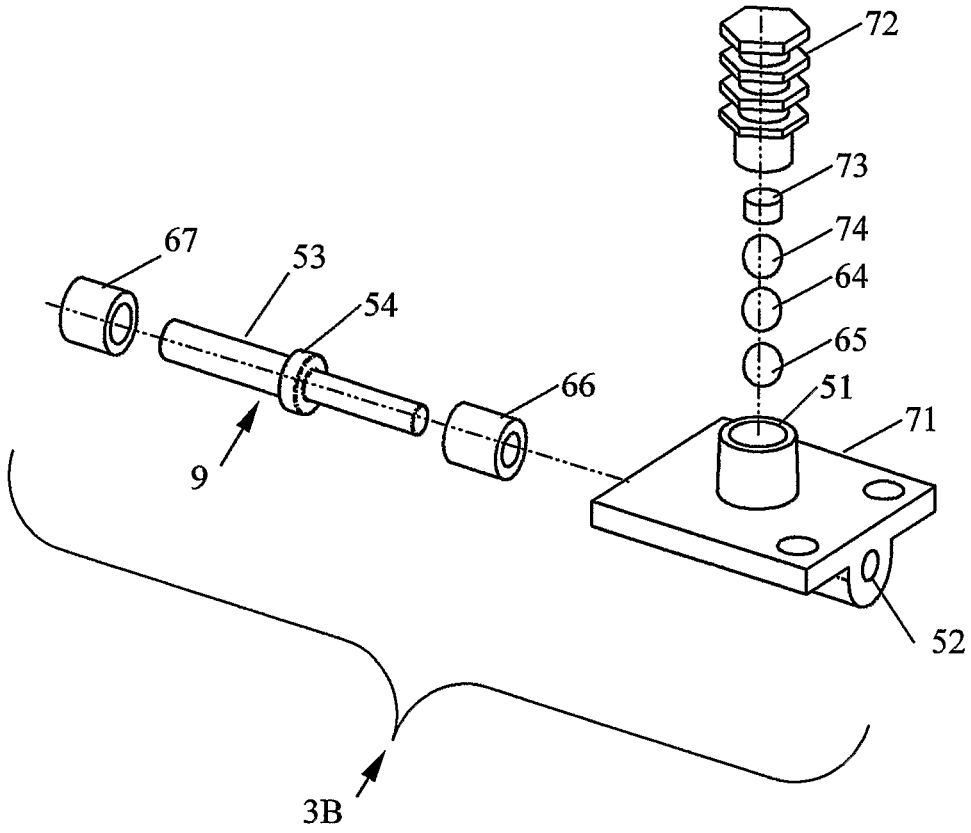
FIG. 9 is an exploded view of the components of the second trigger mechanism.

The second trigger mechanism 3B is illustrated in FIGS. 4, and 9. FIG. 9 is an exploded view of the vertical trigger mechanism 3B and illustrates the components. Similarly as in trigger mechanism 3A, trigger mechanism 3B uses several common components and the action unique to 3B will be disclosed. An additional ball 74 was added to achieve greater height and decrease the thermal path to the housing 71. The bi-metal disk 63 and top housing 61 is replaced by a fusible link 73 and cap 72. Cap 72 is designed to achieve rapid heating of fusible link. When exposed to the extreme temperatures of a grease fire, fuse 73 melts at its melt point temperature and the balls 74, 64, and 65 are allowed to move toward the cap 72 displacing the melted fuse. The release action is the same as in 3A described earlier. Fins located on the cap 72 furnish a larger area for heat to be transfered into cap 72 and to the fuse 73. The wall sections have been reduced to reduce the thermal path to the mass of the other components. The mechanical advantage achieved through the contact angle of ball, as described in trigger mechanism 3A, allows the fuse 73 to be reduced in size and also allows the fuse to reach melt temperature quickly. The melted fuse material is contained within the housing.

Figure 5:
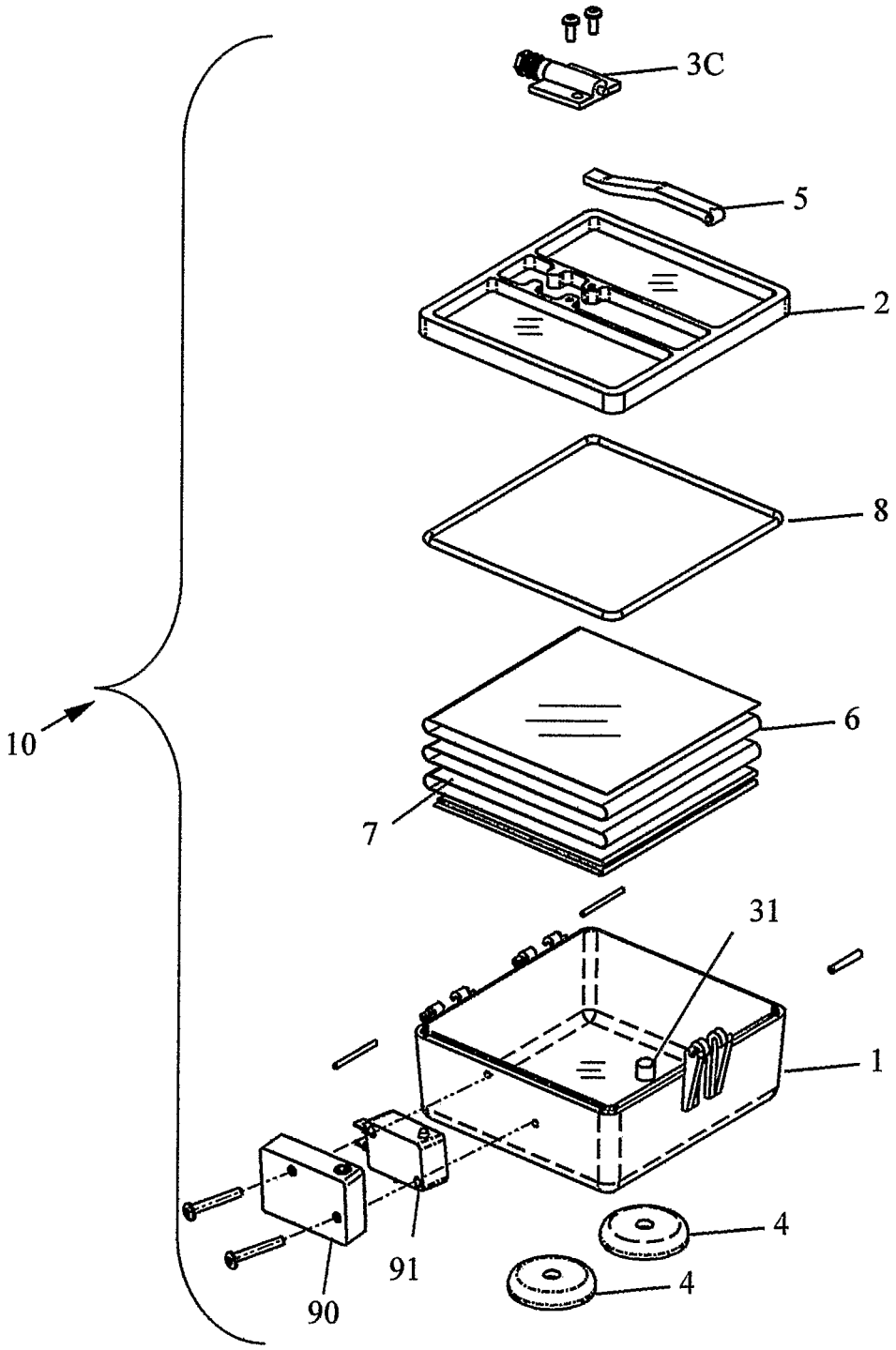
FIG. 5 is an exploded view of the components used in the fire extinguisher present invention third embodiment illustrating the third trigger mechanism.
Figure 10:
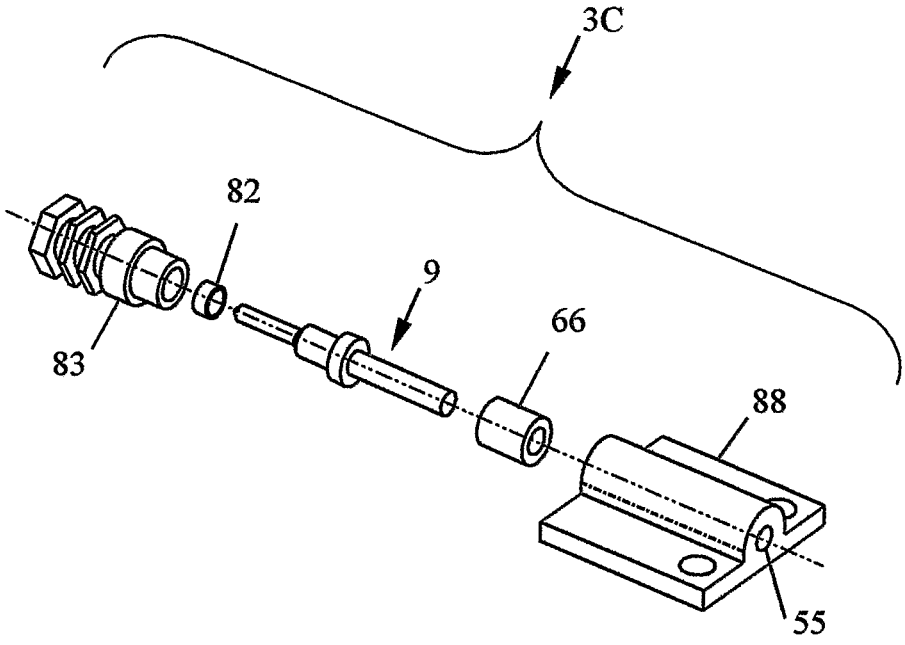
FIG. 10 is an exploded view of the components of the third trigger mechanism.

The third trigger mechanism 3C is illustrated in FIGS. 5, and 10. FIG. 10 is an exploded view of the third trigger mechanism 3C and illustrates the components. This configuration is a direct approach to retracting pin 9. Housing 80 has a guide hole 55 for retracting pin 9, compression spring 66, and cap 83. Fuse 82 is seated in cap 83 and components 9, 66, and 82 are held in housing 88 by cap 83. The spring 66 applies retracting forces to retracting pin 9. Fuse 82 restrains the movement of the pin 9 until it reaches its melt temperature, at that point, pin 9 displaces the melted material and is fully retracted.

Figure 6:
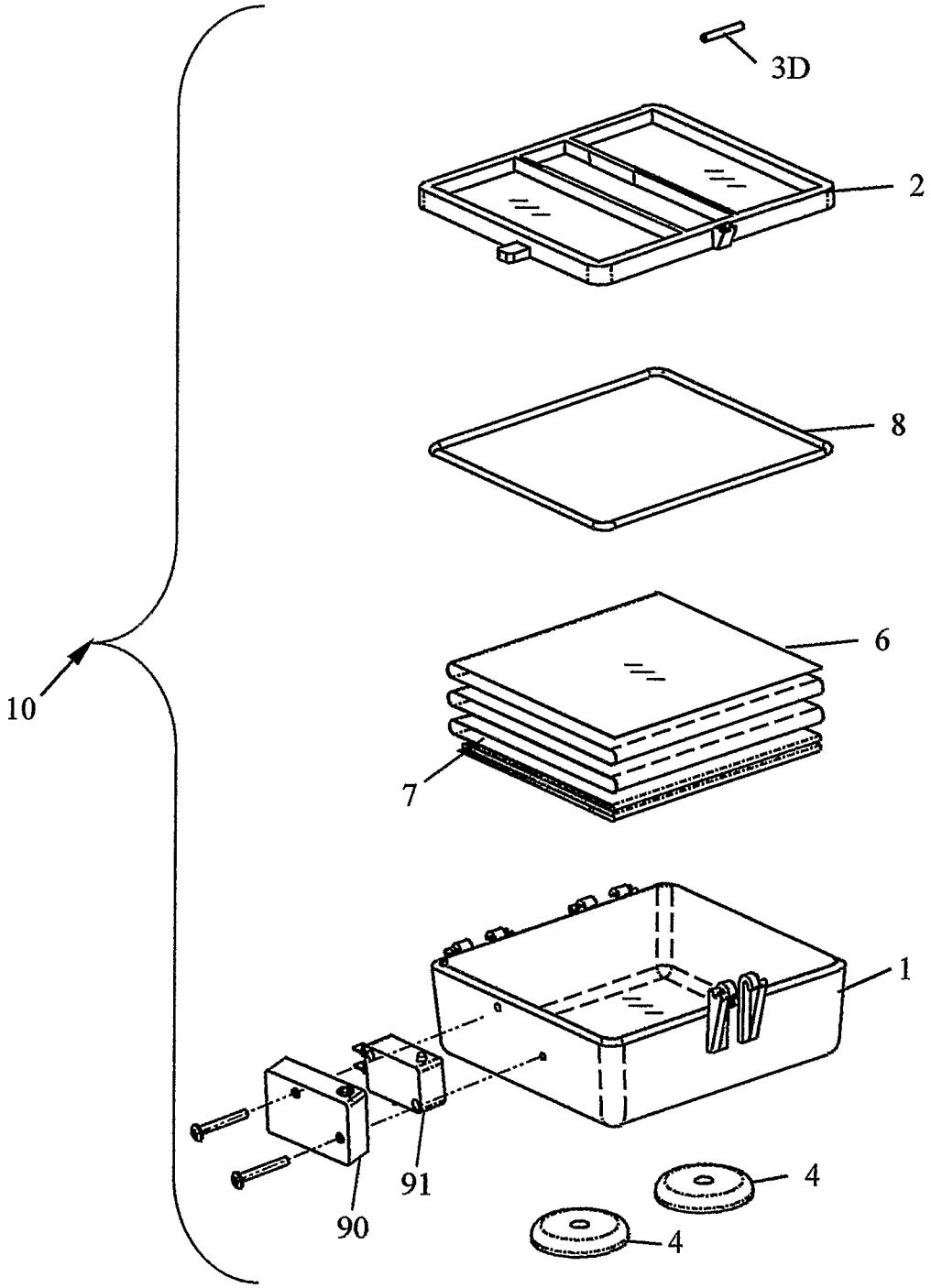
FIG. 6 is an exploded view of the components used in the fire extinguisher present invention forth embodiment illustrating a simple melt type fuse link.
Figure 7:
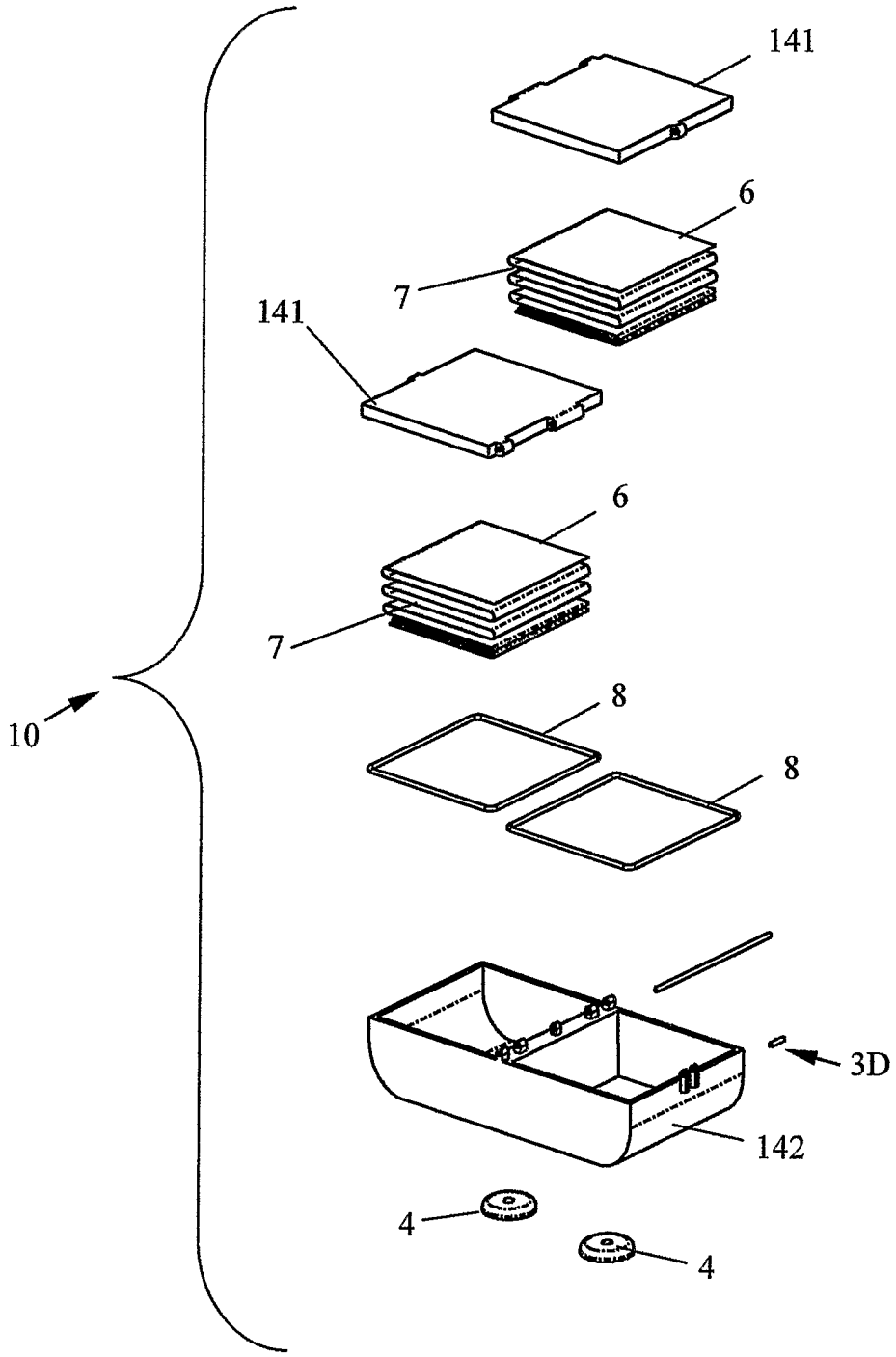
FIG. 7 is an exploded view of the components used in the fire extinguisher present invention fifth embodiment illustrating the duel cavity configuration with a simple melt type fuse link for each cavity.
Figure 14:
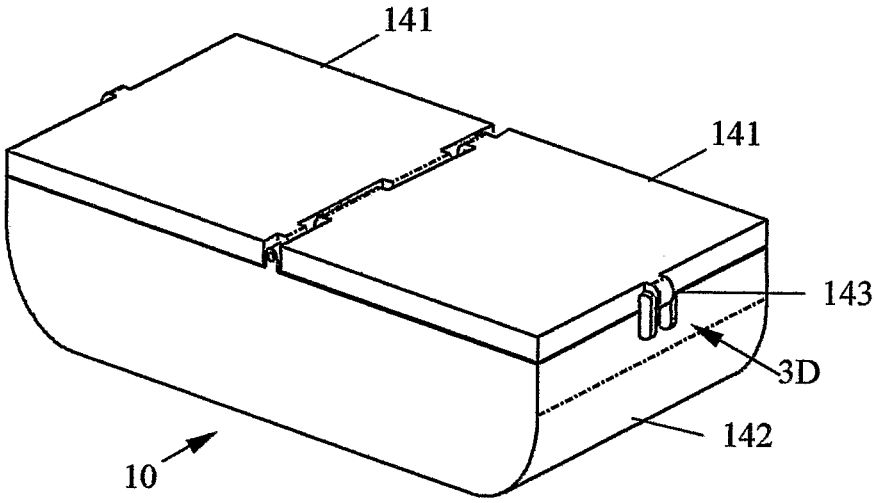
FIG. 14 is a perspective view of present invention and illustrates the duel cavity embodiment illustrating the melt type fuse trigger.

The forth trigger mechanism 3D is illustrated in FIGS. 6, 7, and 14. The latch holder is a pinned hinge arrangement. A fuse material in the form of a pin 143 is used as the latch holder of cover 141 to the latch holder of the enclosure 142. When the fuse is melted, the cover 141 is allowed to fall open releasing the combination of foil 6 and fire suppression agent 7. The deploying of these components is as described previously. In another embodiment of the latch holder is in the configuration in the form of a flat strip with one of its ends secured to enclosure 142 and its other end secured to the cover 5.

Having fully disclosed the actions of the four configurations of the trigger mechanisms 3A, 3B, and 3C clamed in this invention, the following action occurs after the retracting pin 9 is fully retracted. Lever 5, maintaining sealing pressure between the housing 1, the cover 2, and the seal 8 is released, compression forces of the seal 8 combined with gravity and the weight of fire suppression agent 7, forces the said lever 5 and cover 2 to it fully open position. Gravity action on the fire suppression material 7 and foil 6 pulls these components towards the stove 13. As these components descend, the energy of the falling components unfolds the foil 6 guiding and dividing the fire suppression materials 7 in opposite directions, and divides the fire suppression agent into smaller units. Short spaces are created between this unit traveling toward the front burner and the unit traveling toward the rear burners. As the fire suppression agent continues toward the fire, resistance of the air combined with the updraft created by the fire, these smaller units of fire suppression agents are feather separated creating a cascade of fine fire suppression agent fragments which quickly extinguishes the fire and a sufficient quantity of fire suppression agent is added to the burning pan to prevent reignition.

Figure 11:
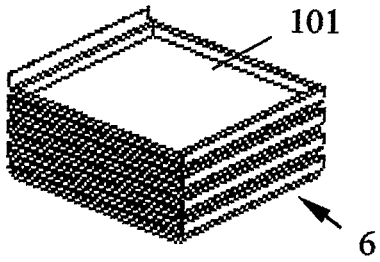
FIG. 11 is a prospective view of foil separator using the cup configuration in the folded position.
Figure 12:
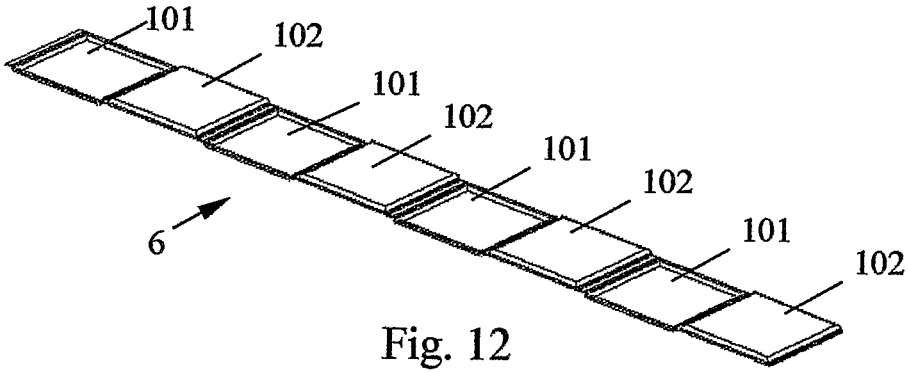
FIG. 12 is a prospective view of foil separator using the cup configuration before being loaded with fire suppression agent and folded.

Another embodiment of the foil 6 illustrated in FIG. 11 and FIG. 12 is made up a formed sheet of foil where depressing are form in the foil in an alternating pattern. Depressions 101 would contain the fire suppression material to be dispensed in one direction and depressions 102 would hold fire suppression material to be dispensed in the opposite direction. The foil and fire suppression is folded forming a configuration as illustrated in FIG. 11.

Figure 13:
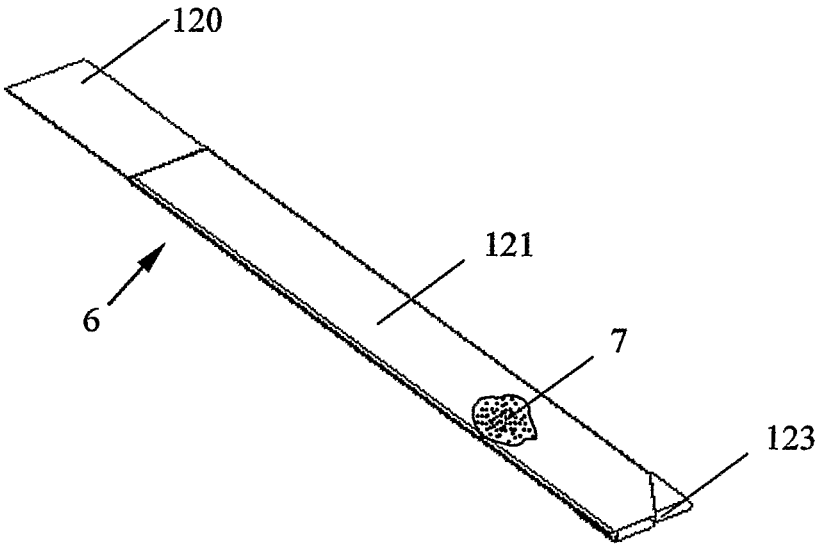
FIG. 13 is a prospective view of foil separator using the tube configuration in the unfolded condition.

Another embodiment of the foil 6 is illustrated in FIG. 13 contain either single or more than one pocket folded into the foil forming a tube. In this embodiment of the invention 10 the invention 10 is placed directly over the pan 12. The fire suppression agent 7 is placed inside the tube in a thin layer. The foil tube is closed by folding the end foil 123 over the open end of formed tube. This is then folded or rolled along section with agent 121 to a size that fit the inside of closure 1 and section 120 is attached to enclosure 1. When deployed the tube unrolls. After unrolling the energy of the falling fire suppression agent unfolds the end of the foil depositing the dry fire suppression agent into the burning pan.

An additional feature, illustrated in FIGS. 2-6, that enhances the appeal of this invention is a micro switch 91 and switch cover 90 activated by closing of cover 2 allows for a low voltage interface 15 between this invention and automatic cut-off devices 14. When activated this switch send a signal to these devices to remove the energy source to the stove. These controls are required for insurance discounts in some areas.

Another embodiment of the invention 10 is made up of a container with two cavities and release triggers as illustrated in FIG. 7 and FIG. 14. This duel system gives additional security with redundant systems for all operations. The operation of this configuration is as described previously.

While the invention has been particularly shown and described with reference to an embodiment thereof, it will be understood by those skilled in the art that various changes in form and detail may be made without departing from the spirit and scope of the invention.

We claim:

1. A method of dispersing a fire suppression agent to extinguish a fire, comprising:

providing a housing including therein a dry fire suppression agent between overlapping folded layers of a flexible sheet, said layers formed by folding the flexible sheet into an accordion-like shape having a plurality of pleats which are alternately folded back and forth, and said fire suppression agent disposed between the overlapping layers formed by the alternately folded plurality of pleats so that the folded flexible sheet separates the fire suppression agent into a plurality of discrete portions; and unlatching a latch to open the housing and release the dry fire suppression agent, at least a part of the flexible sheet moving out of housing, the flexible sheet dispersing the fire suppression agent alternatively in different lateral directions as the flexible sheet unfolds to distribute the plurality of discrete portions of fire suppression agent as alternating pulses.

2. The method of claim 1 in which the fire suppression agent distributes the alternating pulses of fire suppression agent in two alternating opposite directions.

3. A method of making a fire suppression module, comprising:

providing a housing, a flexible sheet, and a fire suppression agent;

folding the flexible sheet into an accordion-like shape having a plurality of pleats which are alternately folded back and forth to form a plurality of overlapping layers with the fire suppression agent placed between the overlapping layers so that the folded flexible sheet separates the fire suppression agent into a plurality of discrete portions to distribute the plurality of discrete portions of fire suppression agent as alternating pulses;

placing the layered flexible sheet and fire suppression agent within the housing; and providing a latch to open the housing and release the flexible sheet and the fire suppression agent.

4. The method of claim 3 further comprises securing a part of the flexible sheet to the housing.

5. The method of claim 3 in which providing a latch included providing a thermally activated trigger to open the latch.

6. The method of claim 5 in which providing a thermally sensitive trigger includes providing a thermally sensitive trigger that includes a bimetallic disk or a low melting temperature material that yields to an unlatching force as its temperature increases.

7. The method of claim 3 further comprising providing a switch that signals device to remove an energy source from a stove.

8. An apparatus for dispersing a fire suppression agent, comprising:

a housing defining a cavity, the cavity having an opening;

a cover for sealing the opening;

a flexible sheet disposed with the cavity, wherein the flexible sheet is folded into an accordion-like shape having a plurality of pleats which are alternately folded back and forth to form a plurality of overlapping layers;

a fire suppression agent disposed between the overlapping layers formed by the alternately folded plurality of pleats so that the folded flexible sheet separates the fire suppression agent into a plurality of discrete portions; and a latch having a first position for maintaining the cover in a position to close the opening and a second position for opening the cover to allow the flexible sheet to unfold;

wherein the flexible sheet is configured to drop and disperse the fire suppression agent as the flexible sheet unfolds upon opening of the cover with the opening downwardly oriented, the unfolding action of the flexible sheet serving to distribute the discrete portions of dropped fire suppression agent alternately in a first lateral direction and in the opposite lateral direction to distribute the plurality of discrete portions of fire suppression agent as alternating pulses.

9. The apparatus of claim 8 in which the flexible sheet is secured in part to the housing and in which the flexible sheet and fire suppression agent are disposed within the cavity such that upon opening the cover, at least a part of the flexible sheet falls outside the cavity.

10. The apparatus of claim 8 in which the flexible sheet is configured such that a portion of the flexible sheet and the fire suppression agent move from the housing primarily by the force of gravity upon opening the cover.

11. The apparatus of claim 8 in which the flexible sheet includes depressions for holding fire suppression material.

12. The apparatus of claim 8 further comprising a thermally activated trigger for moving the latch to the second position upon detecting a fire.

13. The apparatus of claim 12 in which the thermally activated trigger includes a bimetallic disk or a material with a low melting point that yields to an unlatching force as its temperature increases.

14. The apparatus of claim 8 further comprising a switch for signaling a device to remove an energy source from a stove.

15. An apparatus for dispersing a fire suppression agent, comprising:

a housing defining a cavity, the cavity having an opening;

a cover for sealing the opening;

a fire suppression agent disposed between overlapping layers that separates the fire suppression agent into a plurality of discrete portions; and a latch having a first position for maintaining the cover in a position to close the opening and a second position for opening the cover to allow the layers to unfold;

wherein the layers are configured to drop and disperse the fire suppression agent to distribute a plurality of discrete portions of fire suppression agent as alternating pulses.

16. The apparatus of claim 15 in which the layers are stacked vertically with fire suppressant between the layers.

17. The apparatus of claim 15 in which the latch automatically moves into the second position to dispense the fire suppressant upon detection of a fire.

18. The apparatus of claim 17 in which the latch includes a bimetal element that changes shape when heated to sense a fire or an element that melts when heated to sense a fire.

19. The apparatus of claim 15 in which the layers include depressions for containing the fire suppressant.

20. A method of dispersing a fire suppression agent to extinguish a fire, comprising:

providing a housing including therein a dry fire suppression agent between a folded separator forming individual layers of suppression agent, said separator having a plurality layers that are alternately folded, and said fire suppression agent disposed between the overlapping layers formed by the alternately folds so that the folded separator, separates the fire suppression agent into a plurality of discrete portions;

unlatching a latch to open the housing and release the dry fire suppression agent, at least a part of the separator moving out of housing, the separator dispersing the fire suppression agent alternatively in different lateral directions as the separator falls to distribute the plurality of discrete portions of fire suppression agent as alternating pulses.

* * * * *